US012256795B2

(12) United States Patent
Brezzi

(10) Patent No.: US 12,256,795 B2
(45) Date of Patent: Mar. 25, 2025

(54) MAGNETIC BUTTON

(71) Applicant: RIRI S.A., Mendrisio (CH)

(72) Inventor: Simone Brezzi, Padua (IT)

(73) Assignee: RIRI S.A., Mendrisio (CH)

( * ) Notice: Subject to any disclaimer, the term of this patent is extended or adjusted under 35 U.S.C. 154(b) by 0 days.

(21) Appl. No.: 18/258,226

(22) PCT Filed: Dec. 21, 2021

(86) PCT No.: PCT/IB2021/062079
§ 371 (c)(1),
(2) Date: Jun. 19, 2023

(87) PCT Pub. No.: WO2022/137105
PCT Pub. Date: Jun. 30, 2022

(65) Prior Publication Data

US 2024/0114984 A1 Apr. 11, 2024

(30) Foreign Application Priority Data

Dec. 22, 2020 (IT) ..... 102020000031913

(51) Int. Cl.
*A41F 1/00* (2006.01)
*A44B 1/02* (2006.01)
*A44B 1/08* (2006.01)

(52) U.S. Cl.
CPC ..... *A41F 1/002* (2013.01); *A44B 1/02* (2013.01); *A44B 1/08* (2013.01); *A44D 2203/00* (2013.01)

(58) Field of Classification Search
CPC .. A41F 1/002; A44B 1/02; A44B 1/08; A44D 2203/00; Y10T 24/32; A45C 13/1069
See application file for complete search history.

(56) References Cited

U.S. PATENT DOCUMENTS 4,736,494 A * 4/1988 Marchesi ..... A41F 1/002 24/691
4,779,314 A * 10/1988 Aoki ..... A41F 1/002 24/303
4,924,559 A 5/1990 Marchesi
(Continued)

FOREIGN PATENT DOCUMENTS

EP 0170852 A1 2/1986
JP 59126606 A 7/1984

OTHER PUBLICATIONS

International Search Report, issued in corresponding International Application No. PCT/IB2021/062079, date of mailing Mar. 7, 2022 (3 pages).

(Continued)

*Primary Examiner* — Jason W San
*Assistant Examiner* — Rowland Do
(74) *Attorney, Agent, or Firm* — FLYNN THIEL, P.C.

(57) ABSTRACT

A magnetic button having a first button member incorporating a magnet and a second button member incorporating a body made of ferromagnetic material. The first button member and the second button member are magnetically couplable and uncouplable by moving towards and away from each other, respectively, in a coupling direction. The permanent magnet is annular, and a central body made of ferromagnetic material is arranged in a cavity of the permanent annular magnet.

17 Claims, 4 Drawing Sheets

(56) References Cited

U.S. PATENT DOCUMENTS 4,941,235 A * 7/1990 Aoki ..... A45C 13/1069 24/303
4,989,299 A * 2/1991 Morita ..... A44C 5/2071 24/303
5,042,116 A * 8/1991 Ossiani ..... A45C 13/1069 24/303
5,152,035 A * 10/1992 Morita ..... A45C 13/1069 24/303
5,274,889 A * 1/1994 Morita ..... A41F 1/002 24/303
5,473,799 A * 12/1995 Aoki ..... E05C 19/16 24/66.1
5,572,773 A * 11/1996 Bauer ..... A41F 1/002 24/303
5,707,091 A * 1/1998 Morita ..... E05C 19/16 24/303
5,865,482 A * 2/1999 Aoki ..... A45C 13/1069 24/303
5,983,464 A * 11/1999 Bauer ..... H01F 7/0263 24/303
6,131,247 A * 10/2000 Morita ..... A45C 13/1069 24/303
6,170,131 B1 * 1/2001 Shin ..... A41F 1/002 24/66.1
6,215,381 B1 * 4/2001 Aoki ..... A45C 13/1069 335/207
7,065,841 B2 * 6/2006 Sjoquist ..... A44B 1/20 24/303
8,505,174 B2 * 8/2013 Fildan ..... A41F 1/002 24/669
9,392,829 B2 * 7/2016 Manuello ..... A41F 1/002
11,172,717 B2 * 11/2021 Reiter ..... A44B 17/0088
2003/0005558 A1 1/2003 Wong
2003/0024079 A1 * 2/2003 Morita ..... A45C 13/1084 24/303
2004/0174702 A1 * 9/2004 Guerrieri ..... A45C 15/06 362/156
2004/0200043 A1 * 10/2004 Wong ..... A41F 1/002 24/303
2018/0042321 A1 2/2018 Roberman et al.

OTHER PUBLICATIONS

Written Opinion of International Searching Authority, issued in corresponding International Application No. PCT/IB2021/062079, date of mailing Mar. 7, 2022 (5 pages).
International Preliminary Report on Patentability, issued in corresponding International Application No. PCT/IB2021/062079, Date of Completion May 10, 2023 (6 pages).

* cited by examiner

MAGNETIC BUTTON

FIELD OF THE INVENTION

The present invention relates to a magnetic button.

The invention has been developed with particular regard to a button for the textile sector, leather goods or footwear, to be applied to fabrics or leathers or the like.

TECHNOLOGICAL BACKGROUND

There have been known for some time magnetic buttons which are used both on items of clothing and particularly to close purses and bags. Typically, a magnetic button is formed by a pair of elements, of which one is provided with a disk-like magnet and the other is provided with a ferromagnetic portion. The magnetic properties of the metal cause the two elements placed close together to be attached to each other, closing the button.

A problem with magnetic buttons is that, in order to ensure a satisfactory retention of the button, they must be relatively large in diameter and/or thick. While in some applications, such as closing a bag, size is not necessarily an issue, in others it would be preferable to provide a small button.

On the other hand, another problem of known magnetic buttons is that, if they are small, they exert a minimal magnetic field, which is insufficient to ensure acceptable retention of the button, in the presence of normal stresses. For example, if the button is used in an item of clothing, it is naturally necessary for the button to remain closed despite the inevitable stresses to which it is subjected as a result of the movements of the person wearing the garment. Therefore, it is evident that a small button with a small magnet which generates a minimal magnetic field and which therefore tends to become open accidentally, is not suitable.

Some known devices have an annular magnet; a small protuberance on the face of one of the two elements is inserted in a corresponding recess in the face of the magnetic component, in the hole of the annular magnet. This is a solution for ensuring the correct axial alignment of the two elements and to prevent them from sliding transversally with respect to each other. In fact, the force necessary to detach a magnet from a ferromagnetic object by making them slide transversely relative to each other is substantially lower and therefore without the protuberance the risk of accidental release would increase. The protuberance and the recess have a diameter which is necessarily as small as possible because it corresponds to a diameter of the hole in the annular magnet: increasing the diameter of the hole corresponds to a reduction of the volume of the magnet and, therefore, of the intensity of the magnetic field thereof. In the region of the recess, sometimes oxide can form, which affects the aesthetic appearance thereof. Furthermore, a recess with a diameter which is necessarily reduced is subjected to clogging by oxide or impurities. In the event of even partial blockage, the two elements of the button may not perfectly adhere to each other, reducing the magnetic attraction force and, therefore, the seal of the button.

STATEMENT OF INVENTION

An aspect of the invention is to solve the problems of the prior art. Another aspect is to provide a button with reduced dimensions. Another aspect of the invention is to provide a magnetic button with optimum retention. Furthermore, it is desirable to provide a magnetic button that has no exposed portions subject to oxidation. Another aspect is to provide a device which is economical, simple, reliable during use and secure.

According to a first aspect, there is described a magnetic button comprising a first button member and a second button member. The first and second button members can be stably anchored to a substrate. A substrate may be a sheet, for example, a fabric, leather, plastics sheet. The second button member and the first button member can be coupled and uncoupled magnetically by moving them towards and away from each other, respectively. The first button member comprises a magnet. The magnet may be annular, with a cavity which is preferably circular. A central body of ferromagnetic material can be inserted in the cavity of the annular magnet. The second button member comprises a ferromagnetic body.

A button which is formed in this manner has a greater efficiency than a conventional magnetic button with a disk-like magnet: the central body which is inserted in the cavity of the magnet of the first button member, by being magnetized, attracts the second button member independently. The attraction force to which the second button member is subjected when the button is closed is higher than the force which it would have with a disk-like magnet with identical dimensions. However, the attraction force between the male and female components which are maintained at a distance is reduced with respect to the force which it would have with a disk-like magnet. This has the two-fold advantage of making the closed button particularly resistant, therefore preventing it from accidentally becoming disengaged, and of reducing the magnetic field with the button open, preventing the open button from becoming attached to ferrous objects or from being able to re-close on itself without this being desired by the user.

According to a particularly advantageous aspect, the central body of the first button member may have a diameter which is approximately equal to an internal diameter of the cavity of the annular magnet. The central body may have a coplanar face with respect to a face of the annular magnet which is directed, during use, towards the second button member. In this manner, the hole of the annular magnet is completely filled by the central ferromagnetic body. Furthermore, the contiguous faces of the central body and of the annular magnet form a planar surface, against which a second button member is attracted. The interaction between the magnetic ring and the central ferromagnetic body is therefore maximum and consequently the overall magnetic field generated by the ring magnet and central body assembly is maximum.

According to another aspect, there is described a button, in which the central body of the first button member may have an annular projecting edge. The edge may have a transverse dimension, with respect to the coupling direction, greater than the internal diameter of the cavity of the annular magnet. The projecting edge may be in contact with a face of the annular magnet opposite the face of the annular magnet directed, during use, towards the second button member.

In this manner, the projecting edge of the central body further modifies the magnetic field of the annular magnet, making it more intense at the front face, which is directed towards the second button member. At the same time, it minimizes the magnetic field at the rear of the button and therefore also the residual magnetic field with the button closed. The term residual magnetic field is intended to be understood here to be the magnetic field which the closed button generates overall. The magnetic field which is generated with the button closed is different from the magnetic field which is generated by the open button because the second button member screens to a large extent the field generated by the magnet. A high magnetic field at the rear of the button and more generally a high residual magnetic field with a closed button is a relevant problem in many applications. In the case, for example, of a button used in a bag, it will tend to stick to any iron object contained therein or could even cause the demagnetization of payment cards with a magnetic strip. Therefore, it is evident that it is preferable, if not even essential depending on the applications, to reduce to the greatest possible extent the residual magnetic field with a closed button.

Advantageously, in a magnetic button a second button member may have a transverse dimension with respect to the coupling direction comprised between an external diameter and the internal diameter of the annular magnet. A second button member with these characteristics causes the magnetic field lines generated by the magnet to close up mostly at the second button member, improving the retention of the button and reducing the residual magnetic field.

According to an aspect, there is described a magnetic button, in which the first button member may comprise an axial alignment element between the second button member and the first button member. By keeping the components aligned, the alignment element further reduces the risk of accidental disengagement. Preferably, the alignment element is an edge which delineates a housing for a second button member. The correct closure of the button is thereby facilitated. Furthermore, an edge which is configured in this manner delineates a wide concavity (the housing for the second button member) and therefore is not subjected to clogging as a result of impurities becoming accumulated.

Advantageously, the edge is formed by a ring of non-magnetic material. In this manner, it does not interfere with the magnetic field of the button and therefore does not influence the retention of the button.

According to a variant, there is described a magnetic button, in which the first button member comprises an edge which delineates a housing for a second button member, in which the edge comprises a shaped plate. A button which is formed in this manner has only metal portions in view.

According to another aspect, there is described a magnetic button, in which the first button member may comprise a cover which completely covers at least the central body made of ferromagnetic material. The central body is thereby hidden from view and protected from oxidation. Preferably, the second button member may also comprise a cover which completely covers at least the ferromagnetic body for the same purpose.

BRIEF DESCRIPTION OF THE DRAWINGS

Additional features and advantages will be appreciated from the following detailed description of a preferred embodiment of the invention with reference to the appended drawings which are provided purely by way of non-limiting example and in which.

DETAILED DESCRIPTION

Figure 1:
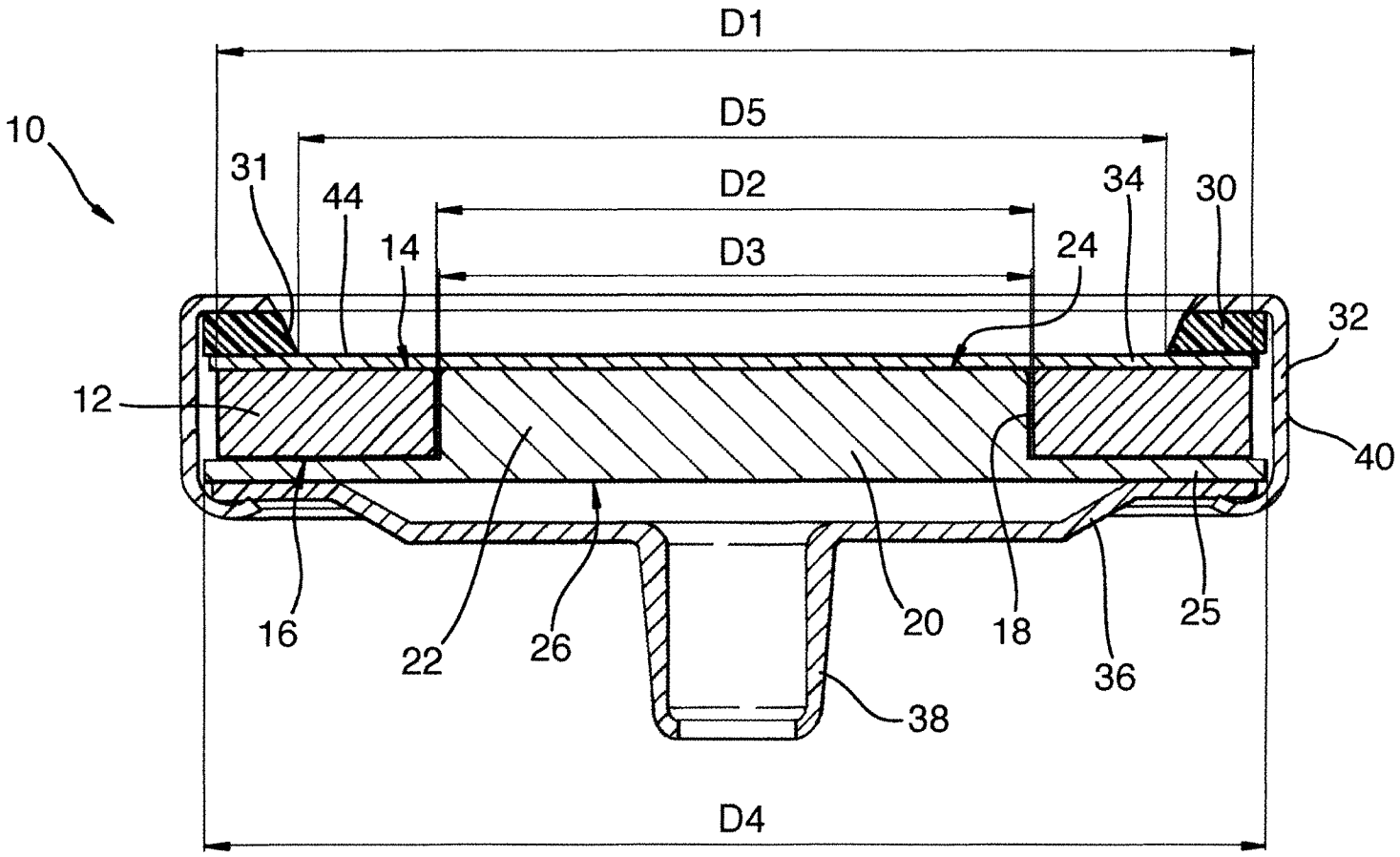
FIG. 1 is a cross-section of a female component of a magnetic button according to the invention.

Now with reference to the drawings, a magnetic button comprises a female component 10 and a male component 50 which constitute a first button member and a second button member, respectively. The female component and the male component are each provided to be fixed stably to a substrate, preferably to a sheet. For simplicity, reference will be made below to sheets which may naturally be sheets made of fabric, plastics material, leather or more generally sheets of flexible materials, as normally used in the sectors of clothing, leather goods and footwear.

The female component 10 comprises an annular magnet 12. The annular magnet 12 is preferably a magnet with neodymium. Even more preferably, it involves a magnet with neodymium 35, 42 or 52, depending on the snap-fit force which it is desirable to obtain.

The annular magnet 12 has an axial polarization, that is to say, it has the north and south poles on the planar faces: on the front face 14, which is directed during use towards the male component 50, and on the rear face 16, which is directed towards the sheet to which the female component 10 is applied. The annular magnet 12 has an external diameter D1 and has a through-hole 18 having an internal diameter D2.

A central body 20 is at least partially provided in a state inserted inside the hole 18 of the magnet 12. The central body 20 comprises a cylindrical portion 22 having such a transverse dimension D3 as to allow it to be received in the hole 18 of the magnet 12; preferably, D3 is slightly less than the internal diameter D2 of the magnet.

A front face 24 of the central body 20 is preferably coplanar with the front face 14 of the magnet 12. The central body 20 further comprises a projecting edge 25 which projects laterally with respect to the cylindrical portion 22. The projecting edge has a transverse dimension D4 which is greater than the internal diameter D2 of the hole; therefore, the projecting edge 25 extends so as to form a ring which is in contact with the rear face 16 of the magnet. Preferably, the projecting edge is circular or polygonal; the transverse dimension D4 is preferably approximately equal to the external diameter D2 of the annular magnet. When the projecting edge is annular and has a diameter D4 equal to the external diameter D2 of the annular magnet, the central body 20 and the annular magnet 12 in which it is inserted together form a solid cylinder.

The central body 20 is made from a ferromagnetic material, for example, iron or a martensitic steel, for example, AISI 420B. In this manner, the central body 20 modifies the magnetic field of the annular magnet 12, making it more powerful at the front face 24 of the central body and on the front face 14 of the magnet and less powerful at the rear face 26 of the central body 20.

In the embodiment depicted, the female component further comprises a ring 30 having an internal diameter D5 between the external diameter D1 and internal diameter D2 of the annular magnet. The ring 30 is positioned in front of the annular magnet 12, that is to say, at the side directed during use towards the male component 50. The ring 30 is preferably made from a non-magnetic material, that is to say that it is not influenced by the presence of a magnetic field. It is further preferable for the material to be relatively compressible. For example, it may be made of nylon or other plastics material.

The ring 30 delineates a housing 44 for a male component 50, which housing 44 has suitable dimensions for receiving it. In particular, the internal diameter D5 of the ring 30 is approximately equal to an external diameter D7 of the male component. In greater detail, the ring 30 preferably has a trapezoidal section or in any case such a section as to form a flared opening 31. Furthermore, the diameter D5 is slightly less than the external diameter D7 of the male component. The difference between the two diameters is in the order of tenths of a millimetre.

The ring 30 which is formed in this manner constitutes both an alignment element between the male component and the female component and a damping element, as better explained below. Furthermore, it contributes to the screening of the residual magnetic field with the button closed.

The annular magnet 12, the central body 20 and, if present, the ring 30 are closed by a cover 32. Preferably, the cover 32 is formed in such a manner that, when the female component is fixed to a fabric, leather or the like, the components which are subjected to oxidation are all hidden. In particular, it is formed in such a manner that the central ferromagnetic body is hidden from view and is protected from air and water. The button is thereby washable.

In the specific example illustrated, the cover 32 comprises a plate 34 which is overlaid on the front face 14 of the magnet 12. The cover also comprises a base 36 which is provided with a shank 38 which is positioned at the rear, that is to say, at the side of the female component which is close to a sheet during use. The shank 38 allows fixing to a sheet made of fabric, leather or the like in known manner, for example, following riveting of a rivet (not illustrated) with the fabric positioned between the rivet and the female component 10. The cover 32 further comprises an edge plate 40 which clamps together the ring 30, the plate 34, the annular magnet 12, the central body 20 and the base 36 along the entire perimeter of the female component 10.

The cover can be made from different materials. Preferably, the plate 34 which is overlaid on the front face 14 of the magnet 12 is made from magnetic stainless steel, for example, from a ferritic stainless steel such as inox AISI 441. A material of this type protects, on the one hand, the ferrous components, preventing oxidation thereof, on the other hand, it does not excessively screen the magnetic field. The other components of the cover 32, that is to say, the base 36 and the edge plate 40, are instead preferably made from a diamagnetic material, for example, stainless steel 304/316, brass, zamak, etc. The cover 32 thereby contributes to screening magnetic fields at the sides and at the rear of the button, where they are disadvantageous for the purposes of engaging the button.

Naturally, this is merely an example which must not be understood in a limiting manner; the cover 32 could in fact be formed by a different number of pieces without thereby departing from the scope of protection.

Figure 2:
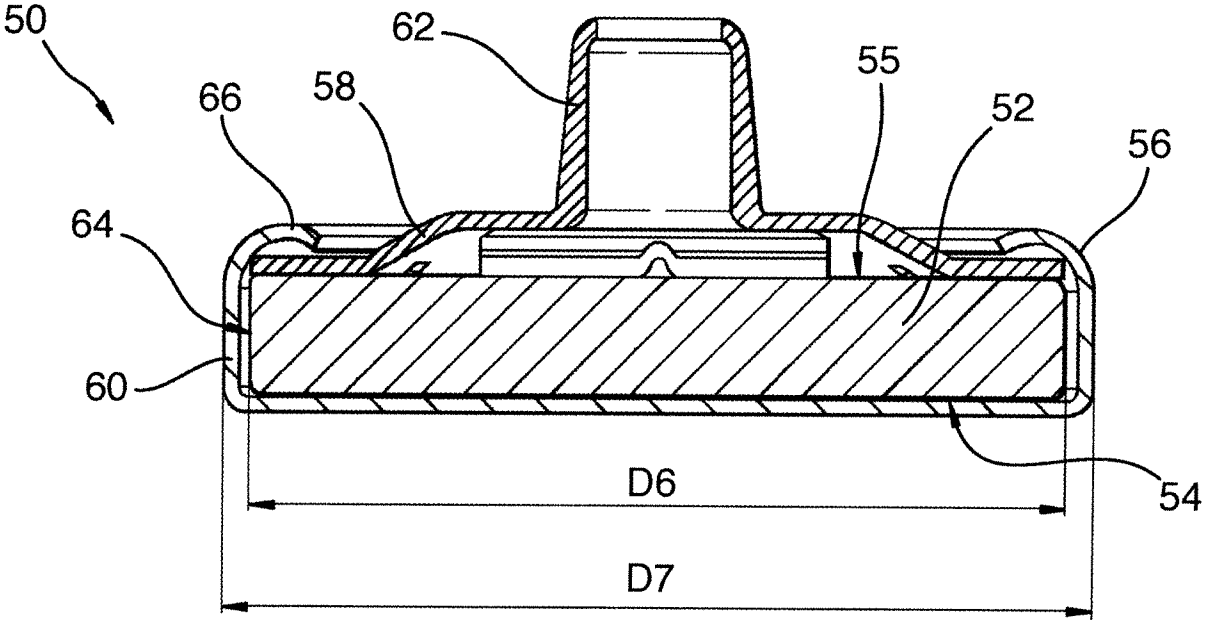
FIG. 2 is a cross-section of a male component.

Now with reference to FIG. 2, the male component 50 comprises a central ferromagnetic body 52. The central body 52 is formed so as to allow the reversible coupling of the female component 10 and the male component 50. The central body 52 of the male component 50 preferably has a disk-like form with a front face 54 directed, during use, towards the female component 10 and a rear face 55 which is directed in the direction of the fabric, leather or other sheet to which the button is fixed. The central body 52 of the male component 50 has a diameter D6 which is between the internal diameter D2 and the external diameter D1 of the annular magnet 12 of the female component 10.

The Applicant has found that the volume of the central ferromagnetic body 52 of the male component 50 has to be preferably equal to at least 75% of the total of the volumes of the annular magnet 12 and the central body 20 of the female component 10 in order to obtain an optimum engagement force.

The male component 50 further comprises a cover 56 having the same functions as the cover 32 of the female component described above. Preferably, the cover 56 is formed in such a manner that, when the male component 50 is fixed to a fabric, leather or the like, the components which are subjected to oxidation are all hidden. In particular, it hides and protects the central ferromagnetic body 52 from air and water in order to make the button washable.

In the specific example depicted, the cover 56 is formed by two portions: a base 58 and a cap 60. The base 58 is moved close to the rear face 55 of the central body 52. It is provided with a shank 62, in a central position. The shank 62 is generally equivalent to the shank 38 of the female component 10: it allows fixing to a substrate in known manner, for example, by riveting a rivet (not depicted) with the substrate positioned between the rivet and the male component 50.

The cap 60 wraps round the central body 52, in particular the front face 54 thereof and a lateral face 64; it then has an edge 66 which is bent over on the base 58 in order to completely close the cover 56. Naturally, the cover 56 of the male component 50 may also be formed by a different number of elements.

Similarly to what has been described above for the female component 10, the cap 60 of the cover 56 is preferably made from magnetic stainless steel; however, the base 58 is preferably made from a diamagnetic material, for example, stainless steel 304/316, brass, zamak, etc.

Figure 3:
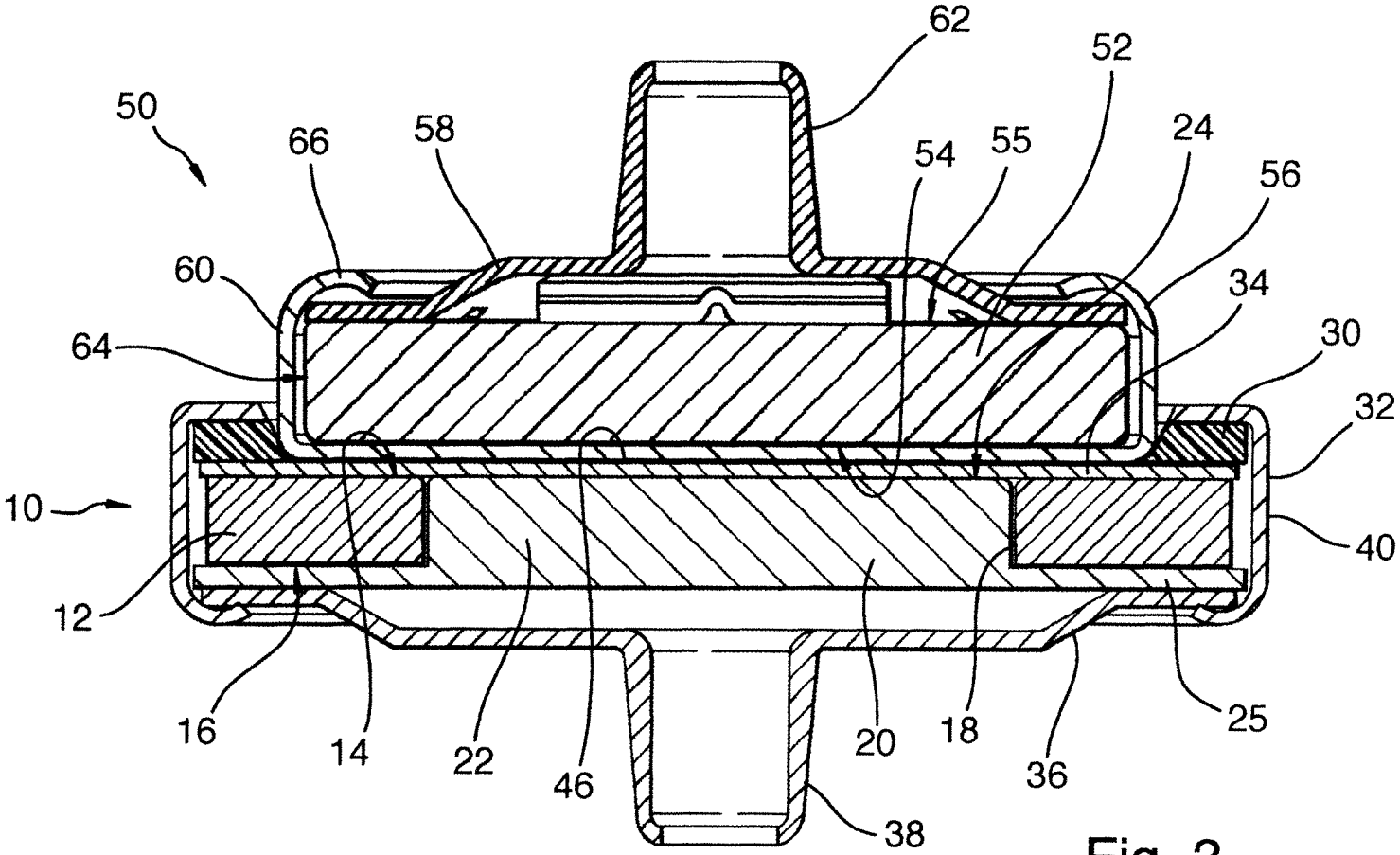
FIG. 3 is a cross-section of a male component and a female component which are engaged with each other.

When the male component 50 and the female component 10 are brought together, the central body 52 of the male component 50 is attracted by the annular magnet 12 of the female component 10. The two components which are positioned sufficiently close together automatically become engaged (FIG. 3).

A total transverse dimension D7 of the male component 50 is approximately equal to a diameter D5 of the housing 44 for a male component which is provided on the female component. As mentioned above, the diameter D5 is slightly less than the external diameter D7 of the male component. The difference between the two diameters is in the order of tenths of a millimetre. This difference between the two diameters causes, when the male component 50 and the female component 10 are engaged, the male component to contact initially the ring 30 and in particular the widened opening 31 thereof. As a result of the pressure applied by the male component, which is attracted by the female component, the ring 30 becomes slightly deformed, allowing the male component 50 to move into contact with a base 46 of the housing 44 (FIG. 3). The ring 30 therefore constitutes a damping system for the button in order to prevent the button from making a noise when it is closed. For "deluxe" applications, the market appreciates the buttons not being noisy during engagement.

In the configuration of a closed button, the central body 52 of the male component 50 is coaxial with the annular magnet 12 of the female component 10 and the ring 30 maintains the correct axial alignment of the two components.

As a result of the fact that the central body 52 of the male component 50 is smaller than the annular magnet 12 of the female component, a greater portion of the magnetic field lines generated by the magnet are closed on the button itself, allowing, on the one hand, optimum retention of the button, on the other hand, a reduction of the residual magnetic field. If the residual magnetic field with the button closed is very high, the button will tend to attract other ferrous objects. The cover 32 and in particular the base 36 and the edge plate 40 also collaborate in the screening of the button in order to minimize the residual magnetic field.

Figure 4:
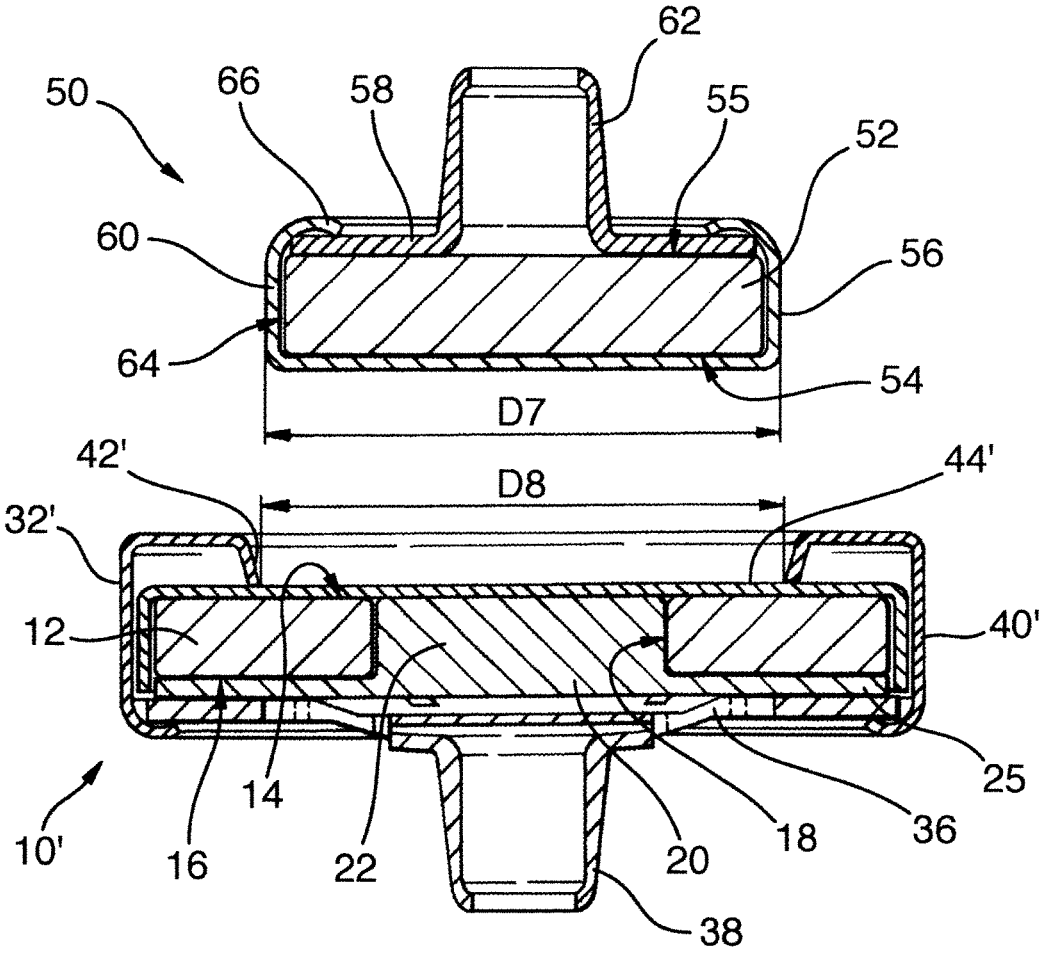
FIG. 4 is a cross-section of a magnetic button according to a variant.

FIG. 4 shows a magnetic button according to a variant of the present invention. The male component 50 is generally similar to the male component 50 described above. The female component 10' is also to a great extent identical to the component 10 described above; the main difference involves the absence of a ring of synthetic material (the ring 30 of the component 10). The alignment element in this variant is constituted by an edge 42' which is obtained by shaping the cover 32' in a suitable manner; the edge plate 40' is bent so as to form the edge 42' which delineates a housing 44' for the male component 50. The housing 44' has a diameter D8 which is substantially equal to or slightly greater than the diameter D7 of the male component in order to allow insertion with play of the male component 50 into the female component 10'.

Naturally, the principle of the invention remaining the same, the forms of embodiment and details of construction may be varied widely with respect to those described and illustrated, without thereby departing from the scope of the invention.

The invention claimed is:

1. A magnetic button comprising:

a first button member comprising:

first and second sides facing away from one another;

an annular magnet defining a cavity therein and having a substantially planar face;

a central body of ferromagnetic material disposed in the cavity and having a substantially planar face, the faces of the annular magnet and the central body being disposed in coplanar relation with one another at the first side of the first button member; and a housing defining a recess therein and including an alignment element bordering at least part of the recess along a periphery thereof, the alignment element defining an internal diameter of the recess and the recess opening outwardly at the first side of the first button member;

a second button member comprising a body of ferromagnetic material and a portion having an external diameter, the internal diameter of the recess being smaller than the external diameter of the portion of the second button member;

wherein the first button member and the second button member are magnetically couplable by moving the first button member and the second button member towards one another along a first coupling direction and into a coupled configuration so that the portion of the second button member is disposed in the recess of the first button member in the coupled configuration, and the first button member and the second button member are magnetically uncouplable by moving the first button member and the second button member along a second coupling direction opposite the first coupling direction and into an uncoupled configuration, the alignment element of the housing being configured to axially align the first and second button members at least during movement of the first button member and the second button member towards one another along the first coupling direction and into the coupled configuration, and the first side of the first button member faces the second button member in the coupled configuration such that the faces of the annular magnet and the central body face towards the second button member in the coupled configuration.

2. The magnetic button according claim 1, wherein the cavity of the annular magnet has an internal diameter and the central body of the first button member has a diameter approximately equal to the internal diameter of the cavity.

3. The magnetic button according to claim 2, wherein the face of the annular magnet is a first face and the annular magnet has a second face facing opposite from the first face and away from the second button member in the coupled configuration, the central body has a flat edge portion projecting in a direction transverse to the first coupling direction, the edge portion having a transverse outer dimension greater than the internal diameter of the cavity of the annular magnet, the edge portion being in contact with the second face of the annular magnet.

4. The magnetic button according to claim 1, wherein the annular magnet has an outer diameter and an inner diameter spaced inwardly from the outer diameter, and the body of the second button member has a dimension transverse to the coupling direction and having a value between the inner diameter and the outer diameter of the annular magnet.

5. The magnetic button according to claim 1, wherein the alignment element comprises a ring of non-magnetic material.

6. The magnetic button according to claim 1, wherein the alignment element comprises a plate, the plate being shaped to assist insertion of the second button member into the recess of the first button member.

7. The magnetic button according to claim 1, wherein the first button member comprises a cover configured to completely enclose at least the central body.

8. The magnetic button according to claim 1, wherein the second button member comprises a cover configured to completely enclose at least the body of the second button member.

9. The magnetic button according to claim 1, wherein the alignment element comprises a deformable material and provides a damping action during movement of the first button member and the second button member towards one another along the first coupling direction and into the coupled configuration.

10. The magnetic button according to claim 1, wherein the external diameter of the portion of the second button member is a maximum diameter of the second button member.

11. A magnetic button comprising:

a first button member comprising:

first and second sides facing away from one another;

an annular magnet defining a cavity therein and having a substantially planar face;

a central body of ferromagnetic material disposed in the cavity and having a substantially planar face, the faces of the annular magnet and the central body being disposed in coplanar relation with one another at the first side of the first button member; and a housing defining a recess therein and including an alignment element bordering at least part of the recess along a periphery thereof, the recess opening outwardly at the first side of the first button member;

a second button member comprising a body of ferromagnetic material;

wherein the first button member and the second button member are magnetically couplable by moving the first button member and the second button member towards one another along a first coupling direction and into a coupled configuration so that a portion of the second button member is disposed in the recess of the first button member in the coupled configuration, and the first button member and the second button member are magnetically uncouplable by moving the first button member and the second button member along a second coupling direction opposite the first coupling direction and into an uncoupled configuration, the alignment element of the housing being configured to axially align the first and second button members at least during movement of the first button member and the second button member towards one another along the first coupling direction and into the coupled configuration, and the faces of the annular magnet and the central body face towards the second button member in the coupled configuration.

12. The magnetic button according to claim 11, wherein the alignment element comprises a plate, the plate being shaped to assist insertion of the second button member into the recess of the first button member.

13. The magnetic button according to claim 11, wherein the alignment element comprises a ring of non-magnetic material.

14. The magnetic button according to claim 13, wherein the ring comprises a deformable material.

15. The magnetic button according to claim 11, wherein the portion of the second button member is snugly disposed in the recess of the first button member in the coupled configuration.

16. The magnetic button according to claim 15, wherein the portion of the second button member has an external diameter and the alignment element defines an internal diameter of the recess, the external diameter of the portion of the second button member and the internal diameter of the recess being similar.

17. The magnetic button according to claim 16, wherein the internal diameter of the recess is smaller than the external diameter of the portion of the second button member.

* * * * *